United States Patent [19]

Albert

[11] 3,964,631

[45] June 22, 1976

[54] DRINKING RECEPTACLE

[76] Inventor: Kenneth J. Albert, 7212 Sunset Blvd., Hollywood, Calif. 90046

[22] Filed: June 24, 1974

[21] Appl. No.: 482,363

[52] U.S. Cl. ..... 220/90.4; 222/518

[51] Int. Cl.[2] ..... A47G 19/22

[58] Field of Search ..... 220/90.4; 222/566–573, 222/511, 518; 215/315, 311, 312

[56] References Cited

UNITED STATES PATENTS

| | | | |
|---|---|---|---|
| 434,211 | 8/1890 | Summer | 222/568 |
| 963,333 | 7/1910 | Stapleton | 222/511 |
| 1,046,803 | 12/1912 | Kendall et al. | 222/511 |
| 1,886,106 | 11/1932 | Kean | 222/568 |
| 2,447,870 | 8/1948 | Polcyn | 220/90.4 |
| 2,554,293 | 5/1951 | Brown | 222/568 |
| 2,578,201 | 12/1951 | Nicorvo | 215/315 |
| 2,706,585 | 4/1955 | Bean | 222/567 |
| 3,256,916 | 6/1966 | Silletti | 222/568 |
| 3,739,938 | 6/1973 | Paz | 220/90.4 |

*Primary Examiner*—George E. Lowrance
*Assistant Examiner*—Allan N. Shoap

[57] ABSTRACT

A drinking receptacle provided with a generally cup like body and an enclosing cover removably coupled to the top portion and upper open end of the cup like body, the cover having a drinking opening near the peripheral rim thereof, and a finger operated valve adapted to open and close said drinking opening whereby the receptacle may contain hot or cold beverages therein and the valve prevents the spillage of said beverages at times when beverages are not being poured or drunk from said drinking opening. The finger operated valve having an actuator reciprocally mounted in the side of the cover and having wedge like actuator structure as well as a finger operating abutment adapted wedgingly to move an arm of said valve away from a lower side of said cover and for actuating a resilient finger on said arm to thereby move a poppet head portion of said valve away from said opening for allowing contents to be poured through said opening and drunk at the rim of said cover.

4 Claims, 5 Drawing Figures

DRINKING RECEPTACLE

BACKGROUND OF THE INVENTION

Various drinking receptacles have been produced in accordance with teaching of the prior art so as to provide for the enclosure of contents in a drinking receptacle and whereby the contents may be drunk through a drinking opening when a valve is opened in the cover of the receptacle. Examples of the prior art are found in U.S. Pat. Nos. 2,152,322 and 3,338,467. These patents disclose valves adapted to provide for lip operation thereof or for finger operation thereof; however, these valves of the prior art have various disadvantages, some of which include a tendency of causing vapor pressure to be rapidly expelled and thereby causing a rapid outflow of hot beverages, for example, when the valve is operated by the lips and, in addition, such prior art valves are not capable of being controlled accurately by a person's fingers preliminary to and concurrently with the usual drinking operations from such closeable containers or receptacles.

SUMMARY OF THE INVENTION

The present invention comprises a drinking receptacle having a valve in the cover thereof and the valve is manually operable from a position substantially diametrically opposite from a location in which a drinking opening is disposed near the rim of the container so that the valve in the cover of the container may be concurrently operated during drinking and so that the valve actuator may be in a relatively upward position relative to a downward position of the drinking opening during drinking operations therefrom.

The drinking receptacle of the invention comprises a novel resiliently mounted poppet valve disposed in a position at a lower side of a top plate portion of the receptacle cover, the poppet head being adapted to open and close a drinking opening near the periphery of the cover and the valve being mounted on a resilient arm fixed to the cover below the normally lower side thereof and the resilient arm being actuated by a reciprocally mounted valve actuator which is radially slideable through a side of the cover and which is provided with a wedge portion adapted to wedge the resilient arm of the valve away from the lower side of the cover. Additionally, the actuator is provided with an abutment adapted to engage a resilient finger of the resilient arm of the valve so as to cause deflection of the resilient arm and the poppet head away from the drinking opening to allow the pouring of liquid or the drinking of liquid therefrom near the rim of the cover.

Accordingly, it is an object of the invention to provide a drinking receptacle having an enclosing cover provided with a drinking opening therein, adapted to be opened or closed by a manually operable valve and the actuator of the valve being disposed diametrically opposite the drinking opening so that the valve actuator may be in an upward position while the drinking opening is in a downward drinking position to allow a finger of the drinker's hand to control the manual opening and closing of the valve in such position.

Another object of the invention is to provide a drinking receptacle provided with a manually operable valve which is adapted to open and close a drinking opening near the peripheral rim of the receptacle cover so that the valve may be manually operated by a drinker's finger preliminary to the placing of the receptacle adjacent the drinker's lips so that steam from hot coffee may first be relieved through the drinking opening thereby alleviating the possibility of steam expulsion of the hot coffee through said opening after the receptacle has been tilted into drinking position.

Another object of the invention is to provide a drinking receptacle having a manually operable drinking valve in the cover thereof whereby hot or cold beverages may be contained in the receptacle and insulated therein so that such beverages may be maintained in either a hot or cold position and so that the person carrying the receptacle may open the drinking valve at will and whereby the contents of the receptacle may be prevented from spillage therefrom during times when beverages are not being drunk through the drinking opening and when the receptacle is being moved about.

Another object of the invention is to provide a drinking receptacle having a manually operable drinking valve in the cover thereof whereby the drinking receptacle may contain hot or cold beverages and may be carried by a person on the move without the danger of spilling the beverages during periods of movement such as may be encountered when the person carrying the receptacle is in motion.

Further object and advantages of the invention may be apparent from the following specification, appended claims and accompanying drawings.

DESCRIPTION OF THE PREFERRED EMBODIMENTS

Figure 2:
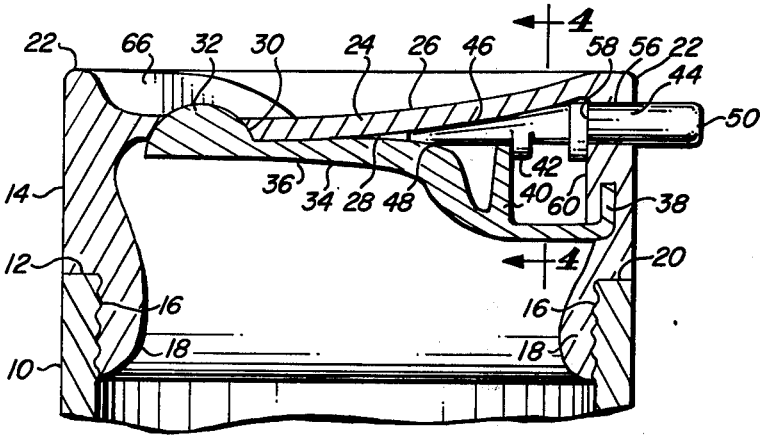
FIG. 2 is an enlarged fragmentary sectional view taken from the line 2—2 of FIG. 1.

The drinking receptacle of the invention is provided with a generally cup like body 10 having an upper open end 12 on which a cover 14 is removably and sealingly secured. As shown in FIG. 2 the cup like body 10 is provided with an internal screw thread 16 near its upper open end 12 and the cover 14 is provided with an externally screw threaded skirt 18 which is screw threadably engaged with the internally screw threaded portion 16 of the body 10.

The cover 14 is provided with a shoulder 20 adapted sealingly to engage the upper open end 12 of the body 10 all as shown best in FIG. 2 of the drawings.

The cover 14 is provided with a peripheral rim 22 which is integral with and surrounds a top plate portion 24 of the cover 14; this top plate portion 24 is provided with upper and lower sides 26 and 28 respectively. The top plate portion 24 is provided with a drinking opening 30 which extends therethrough and the opening 30 is disposed adjacent the rim 22.

The drinking opening 30 is openable or closeable by a poppet valve head portion 32 of a manually operable valve 34 which is provided with a resilient arm 36 having one end portion 38 secured in a slot 40 in the side of the cover member 14. The resilient arm 36 is provided with an offset portion 38 which holds a portion of the arm substantially spaced from the lower side 28 of the top plate 24 and a resilient finger 40 extends upwardly from the offset portion 38 of the resilient arm 36. The finger is engageable with an abutment 42 of a valve actuator 44 which is also provided with a wedge shaped portion 46 adapted to slide between the lower side 28 of the top plate 26 and a corresponding portion 46 of the resilient arm 36 to deflect the poppet head 32 downwardly into the position as shown in FIG. 3 of the drawings.

Figure 3:
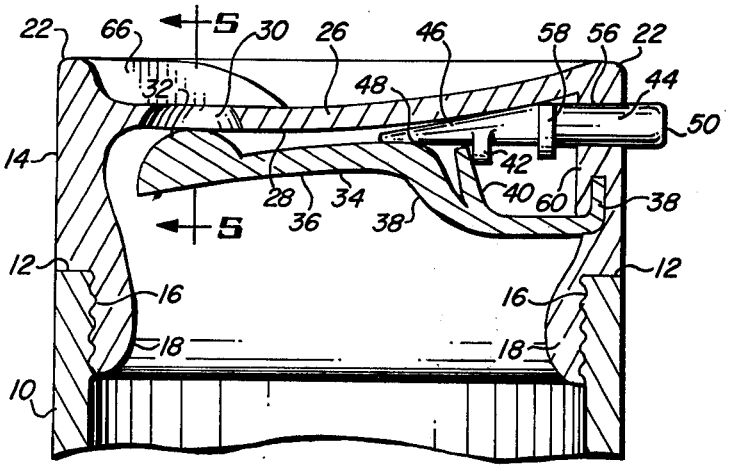
FIG. 3 is a view similar to FIG. 2 showing the drinking valve in open position as compared to the closed position shown in FIG. 2.

Concurrent engagement of the finger 40 and operation of the wedge 46 moves the resilient arm 36 downwardly into a position as shown in FIG. 3 wherein, the poppet head 32 is in open position relative to the drinking opening 30.

Figure 1:
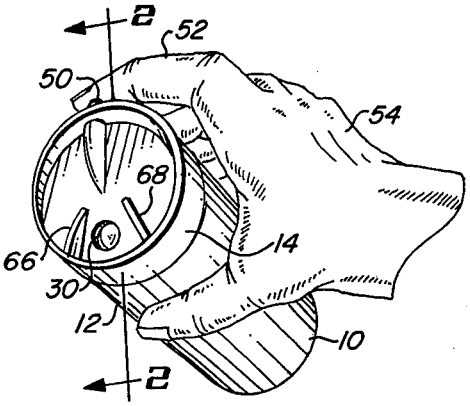
FIG. 1 is a perspective view of a drinking receptacle in accordance with the present invention and showing a person's hand holding the receptacle with a finger of the person's hand in position to actuate the drinking valve of the receptacle.

The valve actuator 44 is provided with an outwardly projecting portion 50 which is adapted to be engaged by a finger 52 of a drinker's hand 54 as shown in FIG. 1 of the drawings. This outwardly projecting finger engaging portion 50 of the actuator 44 projects radially outward from the rim of the cover 14 in a position diametrically opposite to the opening 30 so that the portion 50 may be in an upward position while the drinking opening 30 is in a downward position thus preventing the drinking fluid from gravitating toward the actuator 44 which is reciprocally mounted in a bearing opening 56 in the side of the cover 14. The actuator 44 is also provided with an abutment stop 58 adapted to engage the inner side 60 of the cover 14 when pressure is relieved from the finger engaging portion 50 allowing the resilience of the finger 40 to force the actuator 44 radially outward and to withdraw the wedge shaped portion 46 and to thereby allow the resilient arm 36 to force the poppet head portion 32 into closed position as shown in FIG. 1 of the drawings.

Figure 4:
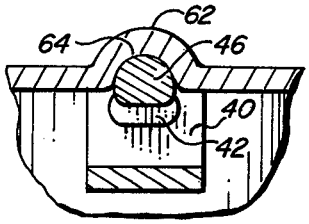
FIG. 4 is a fragmentary sectional view taken from the line 4—4 of FIG. 2.

As shown in FIGS. 1 and 4 of the drawings, an arcuate tunnel portion 62 is integral with the top plate portion 24 and extends radially and serves as a guide for an upper arcuate portion 64 of the wedge portion 46 of the actuator member 44. Thus the wedge portion 46 is guided radially inward and outward in the arcuate tunnel 62 which is integral with the top plate portion 24 of the cover 14.

Figure 5:
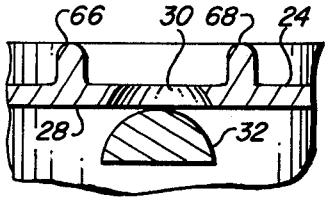
FIG. 5 is a fragmentary sectional view taken from the line 5—5 of FIG. 3.

As shown in FIGS. 1, 3 and 5 the top plate portion 24 at opposite sides of the drinking opening 30 is provided with spout forming ribs 66 and 68 which extend to the peripheral rim 22 to thereby allow a person's lips to engage the ribs 66 and 68 as the rim 22 is placed at a person's mouth and to thereby guide a beverage between the ribs 66 and 68 as it passes from the drinking opening 30 over the rim 22 thus preventing the beverage from flowing laterally over the upper surface 26 of the top plate 24.

In operation the cover 14 is screw threadably removed from the body 10 and the cup like body 10 is filled with a hot or cold beverage as desired and the normal resilient character of the arm 34 holds the poppet head 32 of the valve closed in the drinking opening 30.

When the receptacle is moved around or tipped over, the valve head 32 prevents any spillage from the drinking opening 30 and when it is desired to drink from the opening 30 the valve actuator 44 is reciprocally moved in the opening 56 in an inward direction by pressure of a person's finger on the engaging portion 50 as shown in FIG. 1 and thus steam is relieved from the drinking opening 30 before the opening 30 is placed to the person's lips with the rim 22 in the person's mouth. At this time, the receptacle is tilted upward in the direction as shown in FIG. 1 wherein the drinking opening 30 is downward and the actuator 44 is upward thereby preventing the leakage of liquid around the actuator 44 or preventing the liquid from attempting to leak around the actuator 44 and through the opening 56; it being understood that there must be sufficient clearance in the opening 56 for operation of the actuator 44.

The combined action of the wedge 46 and the abutment 42 in engagement with the finger 40 as hereinbefore described provides for opening of the poppet head 32 to the position as shown in FIG. 3 and the resilient finger 40 tends to return the actuator 44 to the position shown in FIG. 1 when the actuator end 50 is released by the person's finger and when the resilient arm 34 closes the poppet head 32 in the drinking opening 30.

It will be obvious to those skilled in the art that various modifications may be resorted to without departing from the spirit of the invention.

I claim:

1. A drinking receptacle provided with a generally cup like body having a normally upper open end; a cover for said body removably and sealingly secured to said upper open end of said cup like body; said cover having a peripheral drinking rim and a top plate portion surrounded by said rim; said top plate portion having upper and lower sides; said top plate portion having a drinking opening therein; said drinking opening being at a first location near the proximity of said rim; an openable valve disposed and adapted to close and open said drinking opening; a finger engageable valve actuator movably mounted on said cover at a second location near the proximity of said rim; said valve actuator disposed engageably to operate said valve for opening and closing the same; said valve having a poppet head disposed at said lower side of said top plate portion adapted to open and close said opening; a resilient arm means coupled to said cover and carrying said poppet head; said resilient arm means disposed adjacent said lower side of said top plate portion and tending to hold said poppet head in closed position relative to said drinking opening; said cover having a peripheral side provided with a valve actuator bearing opening therein; said actuator reciprocally mounted in said bearing opening; said valve actuator having a finger engaging portion projecting radially outward beyond said peripheral side of said cover; said valve actuator having an inwardly directed valve actuating portion disposed below said top plate of said cover; said inwardly directed valve actuating portion engageable with said resilient arm of said valve and disposed to deflect said resilient arm in a direction away from said lower side of said top plate to thereby open said poppet head of said valve relative to said drinking opening.

2. The invention as defined in claim 1, wherein: said inwardly directed valve actuating portion of said valve actuator comprises a wedge shaped cam structure disposed between said resilient arm and said lower side of said top plate portion.

3. The invention as defined in claim 1, wherein: said resilient arm is provided with a resilient finger extending at substantially right angles to said lower side of said top plate; said valve actuating portion of said valve actuator engageable with said resilient finger and adapted to thereby deflect said resilient arm in a direction away from said lower side of said top plate portion of said cover.

4. The invention as defined in claim 3, wherein: said resilient arm is fixed to said cover at a location spaced from said lower side of said top plate and said valve actuator bearing opening; said resilient finger extending from said resilient arm in a direction toward said lower side of said top plate portion; said valve actuator having an abutment means engageable with said resilient finger for applying force to said resilient arm at a location generally above the position at which said arm is fixed to said cover for thereby deflecting said arm in a relatively downward direction away from said lower side of said top plate portion and for thereby opening said poppet head portion relative to said drinking opening.

* * * * *